US011208748B2

(12) United States Patent
Kim

(10) Patent No.: US 11,208,748 B2
(45) Date of Patent: Dec. 28, 2021

(54) METHOD OF CONTROLLING WASHING MACHINE

(71) Applicant: LG Electronics Inc., Seoul (KR)

(72) Inventor: Kyunghoon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 76 days.

(21) Appl. No.: 16/711,374

(22) Filed: Dec. 11, 2019

(65) Prior Publication Data

US 2020/0181826 A1 Jun. 11, 2020

(30) Foreign Application Priority Data

Dec. 11, 2018 (KR) ..... 10-2018-0159340

(51) Int. Cl.

| | |
|---|---|
| ***D06F 33/48*** | (2020.01) |
| ***D06F 39/08*** | (2006.01) |
| ***D06F 33/00*** | (2020.01) |
| ***D06F 34/18*** | (2020.01) |
| *D06F 103/24* | (2020.01) |
| *D06F 105/48* | (2020.01) |
| *D06F 103/04* | (2020.01) |

(52) U.S. Cl.

CPC ..... *D06F 33/48* (2020.02); *D06F 33/00* (2013.01); *D06F 34/18* (2020.02); *D06F 39/083* (2013.01); *D06F 2103/04* (2020.02); *D06F 2103/24* (2020.02); *D06F 2105/48* (2020.02)

(58) Field of Classification Search

CPC ..... D06F 33/48

See application file for complete search history.

(56) References Cited

FOREIGN PATENT DOCUMENTS

KR 20050012524 2/2005

*Primary Examiner* — Jason Y Ko

(74) *Attorney, Agent, or Firm* — Fish & Richardson P.C.

(57) ABSTRACT

Washing machine technology, in which an initial speed in a drainage process is determined after a rinsing mode is finished, and a laundry distributing operation is performed in which a rotational speed of the motor is maintained at the determined initial speed. The washing machine determines whether a degree of laundry distribution satisfies an allowable range by comparing information detected by a vibration sensor with previously stored reference information. The initial speed is determined to be a rotational speed of the motor at an intersection time point at which vibration of a fundamental wave and vibration of higher harmonics detected by the vibration sensor intersect with each other.

14 Claims, 3 Drawing Sheets

METHOD OF CONTROLLING WASHING MACHINE

CROSS-REFERENCE TO RELATED APPLICATIONS

This application claims priority under 35 U.S.C. 119 and 365 to Korean Patent Application No. 10-2018-0159340, filed on Dec. 11, 2018, in the Korean Intellectual Property Office, the disclosure of which is incorporated herein by reference.

FIELD

The present disclosure relates to a method of controlling a washing machine.

BACKGROUND

In general, a washing machine is an appliance for performing a washing stroke by properly mixing detergent and washing and then performing rinsing and dewatering strokes when a user inserts a contaminated laundry into a washing tank to complete washing.

A drum washing machine may perform a washing operation while a drum into which laundry is inserted is rotated horizontally. The drum washing machine may determine the amount of water suitable for the weight of laundry after the laundry is put into the drum and start a washing stroke while starting to supply water. Here, the laundry may also be called a laundry cloth or a cloth.

When the water level of a reservoir surrounding the drum reaches a set level, the drum may be rotated according to the driving of the motor. The rotation of the drum generates a drop of laundry, whereby washing may be performed for a set time.

Thereafter, when the washing stroke is completed, the contaminated washing water of the reservoir is discharged to the outside through a drain pump, and the rinsing stroke and the dewatering stroke are subsequently performed.

On the other hand, the dewatering stroke may start to be performed when a degree with which the laundry (or clothes) inside the drum is evenly distributed, that is, the degree of laundry distribution is within an allowable range. Here, the degree of laundry distribution may also be referred to as the absence or presence of unbalance or an amount of eccentricity of laundry.

The washing machine determines a quantity of laundry and performs a laundry distributing operation to distribute the laundry evenly in the drum according to the determined quantity of laundry.

In addition, after performing the laundry distributing operation, the degree of laundry distribution (or the amount of eccentricity) of the laundry may be determined by detecting a change in the rotational speed (RPM) of the motor (or drum). In detail, the washing machine may determine that the degree of laundry distribution is appropriate (or that the amount of eccentricity of the laundry is within the allowable range) when the change in the rotational speed (RPM) is within a preset allowable range.

On the contrary, when the change in the rotational speed is out of the allowable range, the washing machine may determine that the degree of laundry distribution is inappropriate (or that the amount of eccentricity of the laundry is out of the allowable range). For example, the washing machine may repeat the laundry distributing operation when the degree of laundry distribution is inappropriate.

When the degree of laundry distribution is inappropriate, the laundry is not evenly distributed in the drum and is biased to a specific portion, causing vibration and noise due to eccentric rotation of the drum.

Related prior art information is as follows.

PRIOR ART DOCUMENTS

Patent Literature

KR 10-2005-0012524 A, Method of Controlling Dewatering in Drum Washing Machine

SUMMARY

An object of the present disclosure is to provide a method of controlling a washing machine capable of reducing the vibration and noise caused by a dewatering stroke.

An object of the present disclosure is to provide a method of controlling a washing machine capable of improving laundry distribution ability to evenly distribute the laundry in the drum.

A method of controlling a washing machine, the washing machine including a cabinet having a doorway through which laundry is inserted or withdrawn, a tub installed in the cabinet, a drum rotatably provided in the tub, a motor for rotating the drum, a vibration sensor installed in the tub, and a controller for controlling operation, the method including determining an initial speed in a drainage process after a rinsing stroke is finished, performing a laundry distributing operation in which a rotational speed of the motor is maintained at the determined initial speed, and determining whether a degree of laundry distribution satisfies an allowable range by comparing information detected by the vibration sensor with previously stored reference information, wherein the initial speed is determined to be a rotational speed of the motor at an intersection time point at which vibration of a fundamental wave and vibration of higher harmonics detected by the vibration sensor intersect with each other.

Furthermore, the method may further include a speed rescanning step of controlling the rotational speed of the motor to be accelerated or decelerated between a lowest reference speed and a highest reference speed when the degree of laundry distribution is out of the allowable range, and determining a calibration speed in the speed rescanning step.

Furthermore, the calibration speed may be determined to be the rotational speed of the motor at a time point at which the vibration of the fundamental wave and the vibration of the higher harmonics, detected by the vibration sensor, intersect with each other.

Furthermore, the speed rescanning step may include controlling the rotational speed of the motor to be decelerated from a current rotational speed of the motor when the vibration of the fundamental wave is larger than the vibration of the higher harmonics and controlling the rotational speed of the motor to be accelerated from the current rotational speed of the motor when the vibration of the fundamental wave is smaller than the vibration of the higher harmonics.

Furthermore, the lowest reference speed may be set to 40 RPM, the highest reference speed may be set to 80 RPM.

Furthermore, the method may further include performing a calibration laundry distributing operation in which the rotational speed is maintained at the determined calibration speed, and determining again whether the degree of laundry distribution satisfies the allowable range by comparing the information detected by the vibration sensor with the previously stored reference information after the calibration laundry distributing operation is performed.

Furthermore, the method may further include returning to the speed rescanning step when the degree of laundry distribution is out of the allowable range as a result of the determination of whether the degree of laundry distribution satisfies the allowable range.

Furthermore, the lowest reference speed may be defined as a rotational speed at which tumble of laundry starts, and the highest reference speed may be defined as a rotational speed at which attachment of laundry starts.

Furthermore, the speed rescanning step may further include determining whether a current rotational speed of the motor is larger than or equal to the lowest reference speed or is smaller than or equal to the highest reference speed, and stopping and then actuating the motor again when the current rotational speed of the motor is smaller than the lowest reference speed or is larger than the highest reference speed.

Furthermore, the initial speed may be determined to be a rotational speed of the motor at a time point at which the vibration of the fundamental wave and the vibration of the higher harmonics become identical to each other initially Furthermore, the method may further include performing a main dewatering operation of rotating the drum at a high speed when the degree of laundry distribution satisfies the allowable range.

DETAILED DESCRIPTION

Figure 1:
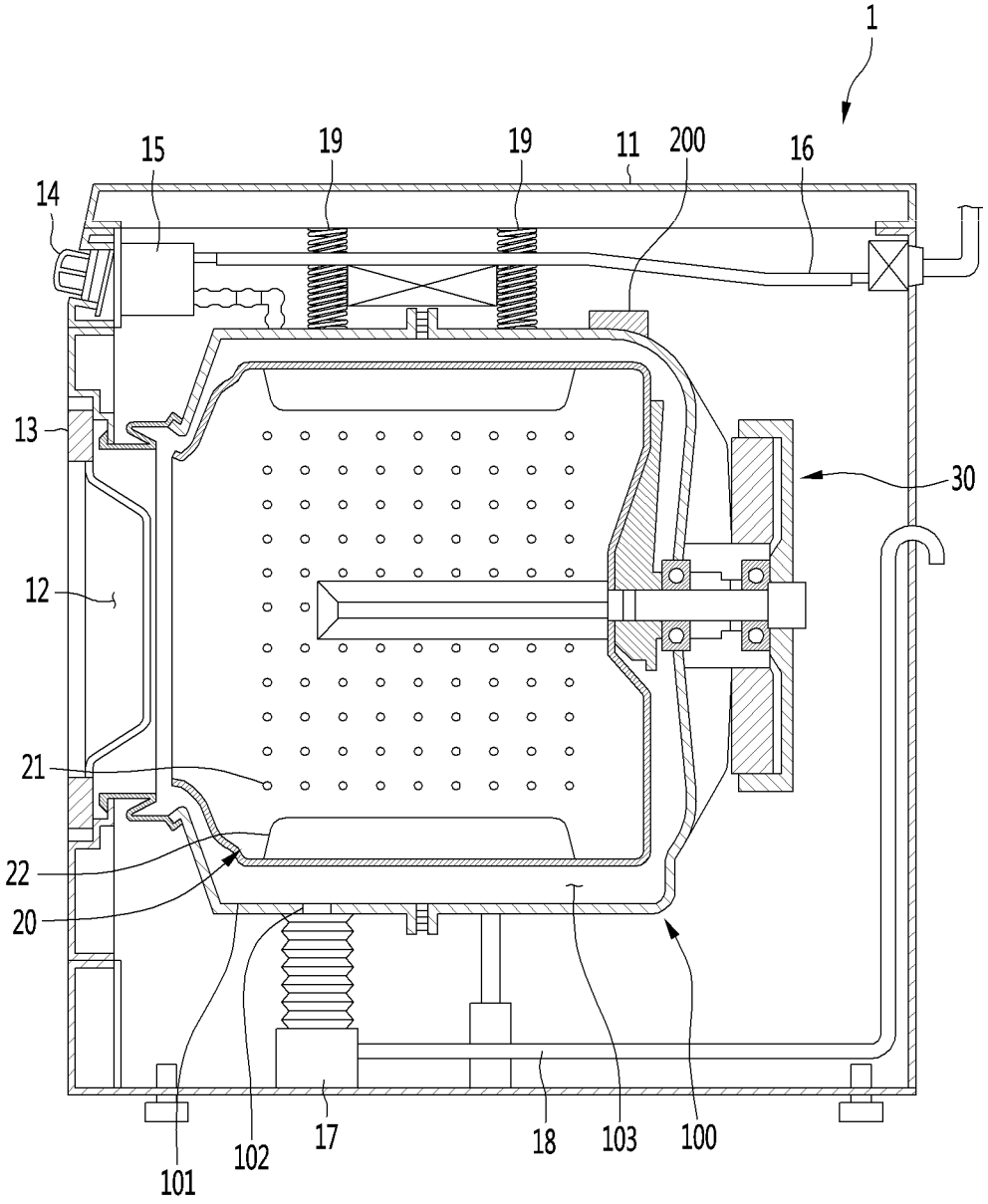
FIG. 1 is a view showing a configuration of a washing machine according to an embodiment of the present disclosure.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

In describing the components of the embodiment according to the present disclosure, terms such as first, second, "A", "B", (a), (b), and the like may be used. These terms are merely intended to distinguish one component from another component, and the terms do not limit the nature, sequence or order of the constituent components. It should be noted that if it is described in the specification that one component is "connected," "coupled" or "joined" to another component, the former may be directly "connected," "coupled," and "joined" to the latter or "connected", "coupled", and "joined" to the latter via another component.

FIG. 1 is a view showing a configuration of a washing machine according to an embodiment of the present disclosure.

Referring to FIG. 1, a washing machine 1 according to the embodiment of the present disclosure may include a cabinet 11 in which an inner space is formed and a tub 100 located in the inner space of the cabinet 11.

A front surface of the cabinet 11 may be formed with a doorway 12 through which laundry is inserted or withdrawn. For example, the cabinet 11 may be formed in a substantially box shape.

The tub 100 may be installed inside the cabinet 11. As one example, the tub 100 may be formed in a substantially cylindrical shape.

The tub 100 may be provided to lie down inside the cabinet 11. In addition, the tub 100 may have a front surface facing the doorway 12.

The tub 100 may be provided in a structure that is suspended to the cabinet 11 by a spring 19 and a damper (not shown). For example, the spring 19 may be connected to the cabinet 11 on the upper side and may be connected to the tub 100 on the lower side.

The spring 19 may be connected to the outer peripheral surface of the tub 100. In addition, the spring 19 may be connected to a central portion of the tub 100. For example, referring to FIG. 1, the spring 19 may be connected to a point bisecting the side surface of the tub 100 having a cylindrical shape, and may extend in a vertical direction.

In addition, a plurality of springs 19 may be provided.

The tub 100 may form a washing space 103 in which washing water is filled. The drum 20 may be accommodated in the washing space 103.

A water collecting part 101 in which the washing water is collected may be formed below the tub 100. The water collecting part 101 may be formed to have a structure in which a inner bottom surface of the tub 100 is recessed downward. Therefore, the washing water may be easily collected in the water collecting part 101.

The water collecting part 101 may be formed with a drain hole 102 in communication with a drain pipe 18 to be described later such that the washing water is drained.

The cabinet 11 may include an operation part 14 for operating the operation of the washing machine 1. For example, the operation part 14 may be located in an upper portion of the front surface of the cabinet 11.

The cabinet 11 may further include a detergent box 15 that is drawn in or out. In one example, the detergent box 15 may be located on an upper front portion of the cabinet 11. That is, the detergent box 15 may be located on the side of the operation part 14. A user may draw out the detergent box 15 to inject detergent into the detergent box 15.

The cabinet 11 may further include a water supply pipe 16 for supplying washing water into the tub 100. The water supply pipe 16 may be connected to an external water supply source. In addition, the water supply pipe 16 may extend into the cabinet 11 through the cabinet 11.

The water supply pipe 16 may be connected to the tub 100 by passing through the detergent box 15. Therefore, the water supply pipe 16 may enable the detergent injected into the detergent box 15 to be supplied to the tub 100 along with the washing water.

The cabinet 11 may further include a drain pump 17 and a drain pipe 18 positioned below the tub 100 in the inner space to circulate or drain the washing water.

The drain pipe 18 may be connected to one side of the bottom surface of the tub 100. The drain pipe 180 may extend to the outside of the cabinet 11.

The drain pump 17 may be installed on a flow path of the drain pipe 18. Thus, the drain pump 17 may force the drainage of the washing water.

The washing machine 1 may further include a door 13 that opens and closes the doorway 12. The door 13 may be rotatably provided in the cabinet 11. The door 13 may open and close the doorway 12 by the rotation.

The washing machine 1 may include a drum 20 rotatably installed inside the tub 100 to wash laundry and a motor 30 mounted on the tub 100 to rotate the drum 20.

The drum 20 may be accommodated in the washing space 103 of the tub 100.

The drum 20 may have a substantially cylindrical shape to form a space in which laundry is accommodated. For example, the drum 20 may be provided to lie down inside the tub 100.

The drum 20 may be formed in a smaller size than the washing space 103 of the tub 100. The outer surface of the tub 100 may be spaced apart from the inner surface of the tub 100.

The drum 20 may be opened toward the doorway 12. Therefore, the laundry may be inserted into or withdrawn from the inside of the drum 20 through the doorway 12.

A plurality of holes 21 through which the washing water passes may be formed of the periphery of the drum 20.

When the drum 20 rotates, the washing water supplied into the inside of the tub 100 may be supplied into the drum 20 through the holes 21 or drained to the outside of the drum 20. That is, the washing water in the washing space 103 may be circulated to the drum 20.

The motor 30 may be provided on the rear surface of the tub 100. That is, the motor 30 may be provided outside the rear surface of the tub 100 opposite to the opened front surface of the tub 100. In addition, a rotation shaft of the motor 30 may be connected to the drum 20 through the rear surface of the tub 100.

That is, the drum 20 may be connected to the rotation shaft of the motor 30. In addition, the drum 20 may be rotatably accommodated in the washing space 103.

In this case, the rotation shaft of the motor 30 may be formed to be horizontal to the ground. That is, the drum 20 may be rotated around the rotation shaft horizontal to the ground, so that the laundry contained therein is moved upward and then dropped.

The inner surface of the drum 20 may be provided with a lift 22 for lifting laundry when the drum 20 is rotated.

The lift 22 may be provided to protrude from the inner peripheral surface of the drum 20. In addition, a plurality of lifts 22 may be provided so as to be spaced apart from each other along the periphery of the inner peripheral surface of the drum 20.

When the washing machine 1 performs a washing mode (or washing stroke), the washing water may be supplied to the washing space 103 of the tub 100 through the water supply pipe 16.

The washing water supplied into the tub 100 may be filled from the bottom of the tub 100. The washing water filled in the tub 100 may be circulated into the drum 20 through the holes of the drum 20.

When the wash water is sufficiently supplied into the tub 100, the motor 30 may be actuated to rotate the drum 20. When the drum 20 is rotated, the laundry inside the drum 20 may be moved upward by the lift 22 and then washed by the washing water while falling.

Thereafter, when the washing is completed, the motor 30 is stopped, and the drain pump 17 may be operated.

When the drain pump 17 is operated, the washing water in the tub 100 may be drained to the outside through the drain hole 102 and the drain pipe 18. The washing machine 1 may perform a rinsing mode when the washing mode is completed.

The washing machine 1 may further include a controller (not shown) for controlling an operation mode and a memory (not shown) for storing information.

The memory (not shown) may store reference information for determining an allowable range for the degree of laundry distribution. For example, the reference information may be information on a vibration (displacement) value detected when laundry distribution is appropriate at a laundry attachment speed of the drum 20 (for example, 80 to 108 RPM). Here, the information on the vibration (displacement) value detected when the laundry distribution is appropriate may be understood as the allowable range for laundry distribution.

That is, the controller may determine whether the degree of laundry distribution to be described later satisfies the allowable range by comparing the vibration information detected by the vibration sensor 200 to be described later with the allowable range for laundry distribution previously stored in the memory (S15 and S50).

The controller may include a microcontroller.

The controller may detect time and may control water supply, drainage, and a rotational speed of the motor 30.

In addition, the controller may receive and process information detected by the vibration sensor 200. The controller may control the operation of the washing machine 1 based on the vibration information received from the vibration sensor 200.

The washing machine 1 may further include the vibration sensor 200 for detecting vibration caused by the rotation of the drum 20.

The vibration sensor 200 may include a six-axis sensor. In addition, the vibration sensor 200 may include a coil type sensor, an optical fiber type sensor, and a piezo type sensor.

The vibration sensor 200 may detect the vibration (displacement) of a vibrating body over time. Here, the vibrating body may be understood as the tub 100.

In addition, the vibration sensor 200 may provide detected vibration (displacement) as a wave. For example, the vibration (displacement) detected by the vibration sensor 200 may form a periodic waveform due to the rotation of the drum 20.

The controller may analyze or process a fundamental wave and higher harmonics from the waveform of vibration (displacement) received from the vibration sensor 200.

Since the vibration sensor 200 is connected to the controller, the vibration sensor 200 may transmit information detected by the vibration sensor 200, that is, the vibration information to the controller. The controller may control the operation of the washing machine 1 using the vibration information.

The vibration sensor 200 may be installed in the tub 100. For example, the vibration sensor 200 may be installed on the outer peripheral surface of the tub 100. In detail, the vibration sensor 200 may be installed at the rear end side of the tub 100.

Here, the rear end side of the tub 100 may be located rearward more than the spring 19.

On the other hand, the front surface or front end of the tub 100 may be firmly coupled to a gasket forming the doorway 12. Due to this, the front end side of the tub 100 may cancel the vibration of the tub 100 by a gasket integrally coupled with the cabinet 11. Therefore, the vibration sensor 200 may be advantageously installed at the rear end side of the tub 100 to perform determination more accurately and precisely than a case of being installed at the front end side.

Figure 2:
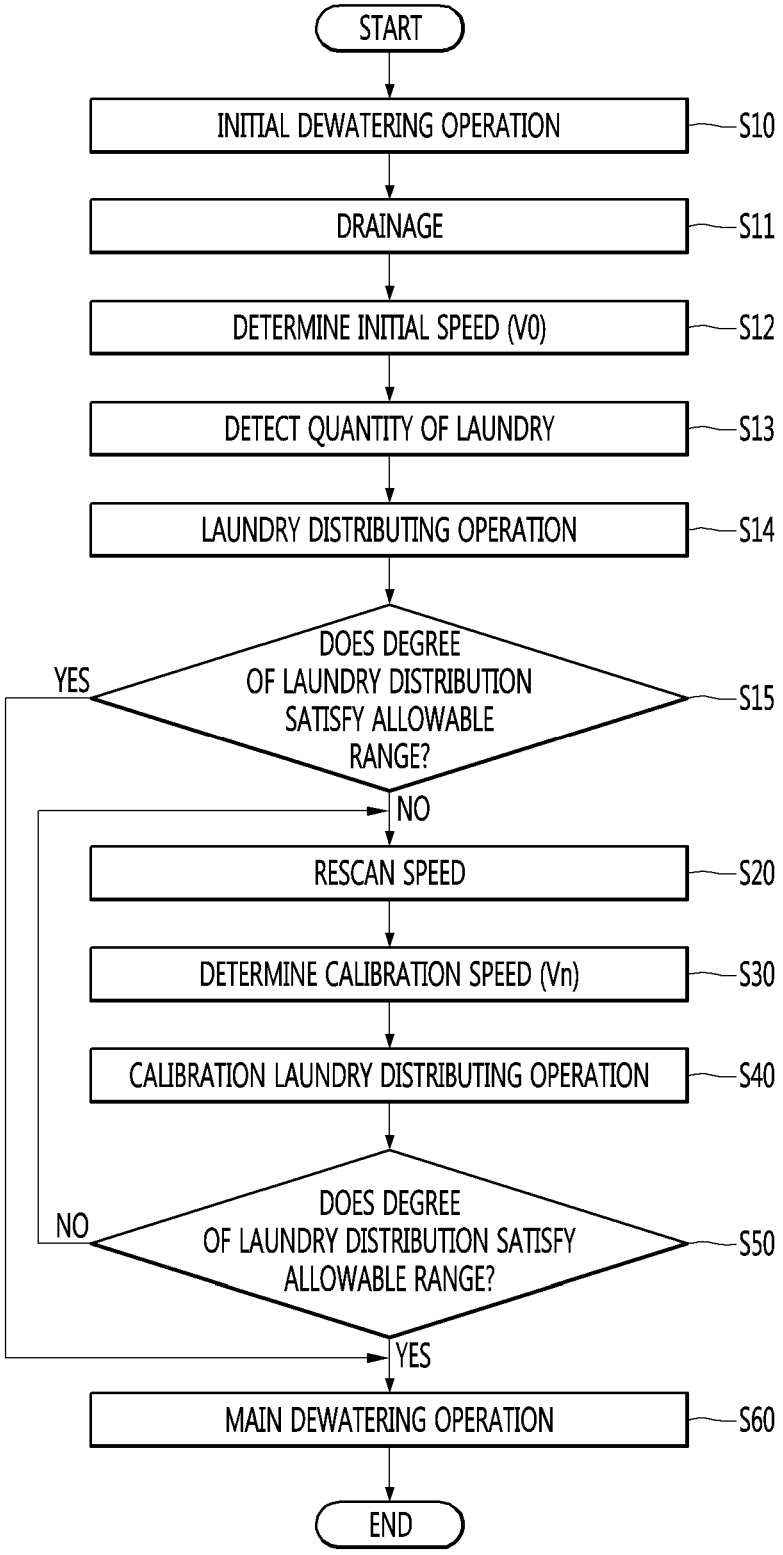
FIG. 2 is a flowchart showing a method of controlling a washing machine according to an embodiment of the present disclosure.
Figure 3:
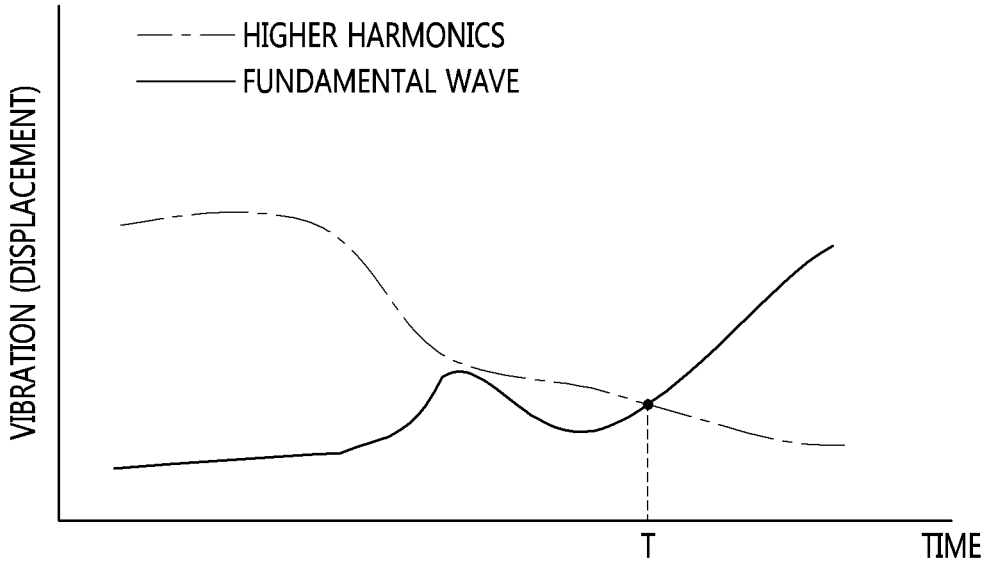
FIG. 3 is a graph showing vibration (displacement) measured by a vibration sensor to determine a rotational speed for laundry distributing operation of the washing machine according to an embodiment of the present disclosure.

FIG. 2 is a flowchart showing a method of controlling a washing machine according to an embodiment of the present disclosure, and FIG. 3 is a graph showing vibration (displacement) measured by a vibration sensor to determine a rotational speed for laundry distributing operation of a washing machine according to an embodiment of the present disclosure.

The washing machine 1 may perform a dewatering stroke when the washing stroke and the rinsing stroke are completed. In more detail, in the rinsing stroke, a tumble or tumble motion for rinsing laundry may be performed after water is supplied to the drum 20.

In the tumble motion, the rotational speed of the motor 30 may be set to a value between 40 RPM and 50 RPM. The rotational speed of the motor 30 may correspond to a rotational speed of the drum 20. Therefore, for convenience of description, the rotational speed of the motor 30 and the rotational speed of the drum 20 may be understood to have ideally the same rotational speed.

The following description for the embodiment of the present disclosure may be described by using the rotational speed of the motor 30 and the rotational speed of the drum 20 in accordance with an operating subject.

That is, the rotational speed of the drum 20 in the tumble motion may be between 40 RPM and 50 RPM.

Referring to FIGS. 2 and 3, after the tumble motion is completed, the washing machine 1 may perform a dewatering stroke. In detail, the washing machine 1 may perform an initial dewatering operation (S10).

The washing machine 1 may perform the dewatering stroke by dividing the dewatering stroke into the initial dewatering operation and a main dewatering operation.

The initial dewatering operation may be understood as an operation performed to evenly distribute the laundry (or cloths) inside the drum 20 while relatively rotating the drum 20 at a low speed.

The dewatering operation may be performed when it is determined that the degree of laundry distribution satisfies the allowable range through the initial dewatering operation. In the present dewatering operation, the moisture contained in the laundry may be removed by centrifugal force while rotating the drum 20 at a high speed.

On the other hand, the washing machine 1 may perform control to repeat the main dewatering operation and the initial dewatering operation. For example, after performing the main dewatering operation, the controller may determine the degree of laundry distribution by reducing the rotational speed of the motor 30 or the drum 20 (for example, 80 to 108 RPM). The initial speed to be described later may be determined while draining the remaining water in the deceleration process. In addition, the controller may repeatedly perform the laundry distributing operation of evenly distributing the laundry in the drum 20 again according to a result of the determination of the degree of laundry distribution.

The washing machine 1 may drain the washing water used in the rinsing stroke when the initial dewatering operation is performed (S11).

That is, the washing machine 1 may perform a drainage operation. In detail, the controller may drain the washing water in the tub 100 used in the rinsing stroke to the outside through the drain pipe 18 by operating the drain pump 17.

The controller may control the rotational speed of the motor 30 such that the water and the remaining water drained from the laundry in the drainage process are effectively discharged.

That is, in the drainage process, the drum 20 may be rotated at a preset rotational speed. For example, in the drainage process, the rotational speed of the motor 30 may be accelerated at a speed of 40 RPM to 80 RPM and controlled to maintain 80 RPM for a preset period of time.

In addition, the washing machine 1 may determine an initial speed V0 in the drainage process (S12).

In detail, the controller may determine the initial speed V0 using vibration information detected by the vibration sensor 200 in the drainage process. Specifically, the controller may determine the initial speed V0 using the vibration (displacement) of the fundamental wave and the vibration (displacement) of the higher harmonics.

Here, the initial speed (V0) may be understood as the rotational speed of the motor 30 and the drum 20 in the laundry distributing operation to evenly distribute the laundry inside the drum 20.

Referring to FIG. 3, vibration (displacement) detected from the vibration sensor 200 with time may be analyzed into a fundamental wave with the lowest frequency and higher harmonics defined as an integer multiple of the frequency of the fundamental wave.

The controller may acquire and/or process the fundamental wave and the higher harmonics with respect to a vibration (displacement) waveform detected by the vibration sensor 200.

The controller may determine the initial speed V0 using the vibration (displacement) of the fundamental wave and the vibration (displacement) of the higher harmonics detected in real time in the drainage process.

For example, the controller may slowly accelerate the rotational speed of the motor 30 from 40 RPM to 80 RPM in the drainage process. The controller may obtain an intersection point (or time point) at which the two vibrations have the same value for the first time by detecting the vibration of the fundamental wave and the vibration of the higher harmonics. In this case, the controller may determine the rotational speed of the motor 30 as the initial speed V0 at an initial intersection point (or time point).

That is, the initial speed V0 may be defined as the rotational speed RPM of the motor 30 at an intersection time point at which the vibration of the fundamental wave and the vibration of the higher harmonics become identical to each other for the first time in the drainage process.

In other words, the initial speed V0 may be defined as the rotational speed of the motor 30 at the intersection point at which the vibration of the fundamental wave and the vibration of the higher harmonics intersect with each other for the first time.

When the laundry inside the drum 20 leans to one side, higher harmonic components tend to increase as the rotational speed of the motor 30 is relatively lower, and the fundamental wave components tend to increase as the rotational speed of the motor 30 is relatively higher. Therefore, in order to separate the tangled or knotted clothes from each other and evenly distribute the separated clothes in the drum 20, this work may be most effectively performed when the fundamental and harmonic components keep a balance.

As a result, the rotational speed of the motor 30 at an intersection point which the vibration (displacement) of the fundamental wave and the vibration (displacement) of the higher harmonics become identical to each other may be defined as a rotational speed at which a phenomenon in which clothes inside the drum 20 are knotted and then separated occurs most frequently.

For example, referring to FIG. 3, an intersection point at which the fundamental wave and the higher harmonics have the same vibration (displacement) at a first time T is generated. In this case, the controller may determine the rotational speed RPM of the motor 30 at the first time T as the initial speed V0. Therefore, the initial speed V0 may have a value between 40 RPM and 80 RPM.

The determined initial speed V0 may be stored in a memory.

The washing machine 1 may detect the quantity of laundry after determining the initial speed V0 (S13).

Here, step S13 may be referred to as a laundry quantity detection step.

In the laundry quantity detection step, the washing machine 1 may detect the weight of laundry loaded into the drum 20. In detail, the controller may rotate the drum 20 to reach a predetermined speed. This process may be repeatedly performed. In one example, the constant speed may be about 40 RPM.

The controller may measure a lead time required to reach the predetermined speed. Since the lead time relatively increases as the weight of the laundry increases, the controller may measure the weight of the laundry by measuring the lead time.

When the laundry quantity detection step is completed, the washing machine 1 may perform a laundry distributing operation to distribute the laundry in the drum 20 to be evenly balanced (S14).

Here, the laundry distributing operation may be understood as an operation for controlling the operation of the drum 20 to evenly distribute the laundry introduced into the drum 20.

In detail, when the laundry distributing operation is started, the controller may control the rotational speed of the motor 30 to maintain the initial speed V0 determined in step S12.

The rotational speed of the motor 30 at the intersection point which the vibration of the fundamental wave and the vibration of the higher harmonics are identical to each other may be understood as a rotational speed at which a phenomenon in which several clothes are knotted and separated inside the drum 20 occurs most frequently. Therefore, when the drum 20 is rotated to maintain the initial speed V0, the frequency of the phenomenon in which several clothes are knotted and separated may be relatively higher than those at other rotational speeds.

As a result, when the drum 20 is rotated to maintain the initial speed V0, the laundry inside the drum 20 may be evenly distributed to the empty space of the drum 20.

The controller may control the initial speed V0 to be maintained for a preset period of time.

In addition, the controller may perform control to normally maintain the initial speed V0 by controlling acceleration and deceleration for the rotation of the motor 30. Due to the laundry distributing operation, the laundry in the drum 20 may be evenly distributed.

After the laundry distribution mode is performed, the washing machine 1 may determine whether the degree of laundry distribution satisfies an allowable range (S15).

In this case, the determining of whether the degree of laundry distribution satisfies the allowable range may be referred to as a laundry distribution suitability determination step.

Whether the degree of laundry distribution satisfies the allowable range may be understood as whether the degree with which the laundry inside the drum 20 is evenly distributed, that is, the degree of laundry distribution is suitable.

In detail, the controller may determine whether the degree of laundry distribution satisfies the allowable range by comparing the vibration information detected by the vibration sensor 200 with reference information previously stored in the memory, that is, an allowable range for laundry distribution.

The controller may determine whether the degree of laundry distribution satisfies the allowable range based on information received from the vibration sensor even during the laundry distributing operation. In this case, determining the degree of laundry distribution during the laundry distributing operation may be referred to as a primary laundry distribution degree determination step, and step S15 may be referred to as a secondary laundry distribution degree determination step.

The allowable range for laundry distribution may be understood as vibration information that may be detected in a state in which the laundry is evenly distributed when the drum 20 rotates at a laundry attachment speed. For example, the controller may determine that the allowable range for laundry distribution is satisfied when a vibration value detected at the laundry attachment speed is smaller than or equal to a specified value and the deviation between the highest and lowest values of the detected vibration is less than or equal to a predetermined reference value.

That is, when the vibration information detected by the vibration sensor 200 satisfies the allowable range for laundry distribution, the controller may determine that the degree of laundry distribution satisfies the allowable range for laundry distribution.

Of course, whether the degree of laundry distribution satisfies the allowable range may be determined by determining whether a change amount in the rotational speed of the motor 30 satisfies the the allowable range after the rotational speed of the drum 20 reaches the laundry attachment speed (for example, 80 108 RPM).

When the degree of laundry distribution satisfies the allowable range, the washing machine 1 may perform the above-described dewatering operation (S60).

On the other hand, when the degree of laundry distribution does not satisfy the allowable range, the washing machine 1 may rescan the rotational speed of the motor 30 to perform the laundry distributing operation again (S20). Here, step S20 may be referred to as a speed rescanning step.

In detail, when the controller determines that the degree of laundry distribution is out of the allowable range, that is, when it is determined that the laundry distributing operation is not performed well, the controller may control the rotational speed of the motor 30 to be decelerated to a rotational speed (for example, 40 RPM) at which the tumble starts, or to be accelerated to a rotational speed (for example, 80 RPM) at which laundry attachment starts to occur.

For example, the controller may control the rotational speed of the motor 30 to repeat the acceleration and deceleration relatively slowly between the speed at which the tumble starts and the speed at which the laundry attachment starts.

In addition, when the vibration of the fundamental wave is larger than the vibration of the higher harmonics, the controller may control the rotational speed of the motor 30 to be lower than a current rotational speed. When the vibration of the fundamental wave is smaller than the vibration of the higher harmonics, the controller may control the rotational speed of the motor 30 to be higher than the current rotational speed.

In other words, the controller may control the rotational speed of the motor 30 to reach up to 80 RPM while changing the slope of the acceleration from 40 RPM in a positive (+) or negative (−) direction according to comparison between vibration of the fundamental wave and vibration of the higher harmonics.

While performing the above process, the controller may rescan the rotational speed of the motor 30 for a rotational speed at the intersection point where the vibration of the fundamental wave and the vibration of the higher harmonics intersect with each other.

The washing machine 1 may determine a calibration speed Vn in the rescan process (S30).

In detail, the controller may determine the rotational speed of the motor 30 as the calibration speed Vn at the intersection point (or time point) at which the vibration (displacement) of the fundamental wave and the vibration (displacement) of the higher harmonics become identical to each other in the rescan process described above. For example, the controller may store the calibration speed Vn determined in the first rescan process as a primary calibration speed V1 in the memory.

That is, the calibration speed Vn may be defined as the rotational speed RPM of the motor 30 at an intersection point (or time point) at which the vibration of the fundamental wave and the vibration of the higher harmonics initially intersect with each other in the rescan process. In this case, the rotational speed of the motor 30 may satisfy a range of more than 40 RPM and less than 80 RPM.

The calibration speed Vn may be determined in the same manner as the method for determining the initial speed V0. Therefore, the above description for the initial speed V0 may be referred for a description for a process of determining the calibration speed Vn.

As described above, the rotational speed of the motor 30 at the intersection point at which the vibration (displacement) of the fundamental wave and the vibration (displacement) of the higher harmonics are identical to each other may be understood as a rotational speed at which a phenomenon in which several clothes in the drum 20 are knotted and separated occurs most frequently. Therefore, the calibration speed Vn may be understood as a rotational speed in a calibration laundry distributing operation (S40) to be performed later.

When the calibration speed Vn is determined, the washing machine 1 may perform a calibration laundry distributing operation (S40).

That is, since the laundry distribution is not properly achieved in the above-described laundry distributing operation S14, the controller may perform control to perform the laundry distributing operation again based on the calibration speed Vn.

In detail, the controller may control the rotational speed of the motor 30 to maintain the calibration speed Vn determined in step S30.

As described above, according to the calibration speed Vn, the laundry may be evenly distributed in the drum 20.

On the other hand, the controller may perform the calibration laundry distributing operation for a predetermined time, or may perform control to repeat calibration laundry distributing operation a predetermined number of times.

After the calibration laundry distributing operation is completed, the washing machine 1 may determine again whether the degree of laundry distribution satisfies the allowable range.

The controller may determine whether the degree of laundry distribution satisfies the allowable range after the calibration laundry distributing operation by comparing the vibration information detected by the vibration sensor 200 with the allowable range for laundry distribution previously stored in the memory.

In this case, when the degree of laundry distribution satisfies the allowable range, the washing machine 1 may enter a main dewatering operation (S60).

On the other hand, when the degree of laundry distribution is out of the allowable range, the washing machine may return to step S20 to repeat the above-described process. In this case, the calibration speed Vn determined through the repeated process may be stored in the memory as the secondary calibration speed V2.

According to the method of controlling the washing machine according to the embodiment of the present disclosure, the washing machine 1 may determine the rotational speed which is most advantageous for the laundry distributing operation and rotate the drum 20 at the determined rotational speed, thereby achieving balance and equilibrium of the laundry quickly. Therefore, it is possible to quickly reduce vibration and noise due to unbalance in the dewatering stroke.

Figure 4:
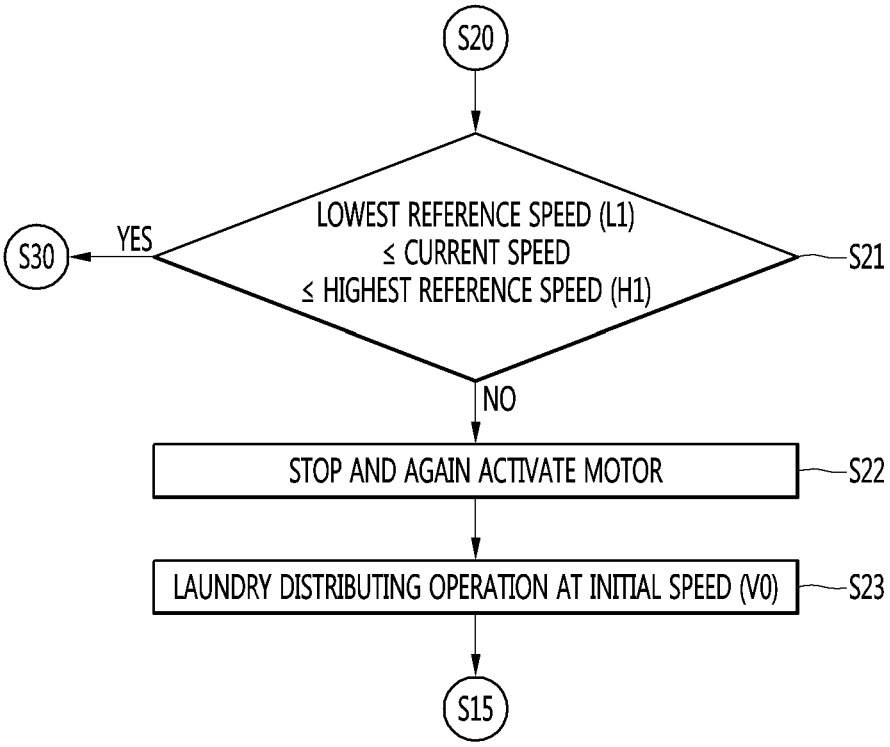
FIG. 4 is a flowchart showing step S20 of FIG. 2 in more detail.

FIG. 4 is a flowchart illustrating step S20 of FIG. 2 in detail.

As described above, the speed rescanning step (S20) may be performed when the rotational speed of the motor 30 is between a speed at which tumble starts (for example, 40 RPM) and a speed at which laundry attachment starts (for example, 80 RPM).

Here, a section of speed between between the speed at which the tumble starts and the speed at which the laundry attachment starts may be referred to as a rescan speed section.

That is, in the speed rescanning step S20, the rotational speed of the motor 30 should satisfy the rescan speed section. However, when the laundry attachment speed is accelerated to be the reference speed, when the return from the dewatering stroke occurs or when the abnormal operation of the motor occurs, the rescan speed section may not be satisfied.

When the calibration speed Vn is determined in a state in which the rescan speed section is not satisfied, a problem may occur that the vibration of the fundamental wave and the vibration of the higher harmonics have reflected the influence due to the high speed rotation of the motor 30.

As a result, a problem may occur that it is difficult to define the calibration speed determined in a state of being out of the rescan speed section as a speed that is advantageous for laundry distribution.

Therefore, in order to obtain a more accurate and effective calibration speed, the washing machine 1 may determine whether the rotational speed of the motor 30 corresponds to the rescan speed section in the speed rescanning step (S20).

Referring to FIG. 4, when the speed rescanning step (S20) is performed, the washing machine 1 may determine whether the current rotational speed of the motor 30 is larger than or equal to the lowest reference speed L1 and or smaller than or equal to the highest reference speed H1.

The lowest reference speed L1 may be defined as a speed at which the tumble starts. For example, the lowest reference speed L1 may be set to 40 RPM.

The highest reference speed H1 may be defined as a speed at which the laundry attachment starts. As one example, the highest reference speed H1 may be set to 80 RPM.

That is, the controller may determine whether the current rotational speed of the motor 30 corresponds to a speed between the speed at which the tumble starts and the speed at which the laundry attachment starts.

When the current rotational speed of the motor 30 is larger than or equal to the lowest reference speed L1 and or smaller than or equal to the highest reference speed H1, the washing machine 1 may perform a step (S30) of determining the calibration speed Vn by repeatedly performing acceleration and deceleration.

On the other hand, When the current rotational speed of the motor 30 is not larger than or equal to the lowest reference speed L1 and or smaller than or equal to the highest reference speed H1, the washing machine 1 may stop driving of the motor 30 and again activate the motor 30 (S22).

In addition, the washing machine 1 may again perform the laundry distributing operation at the initial speed V0.

In detail, the controller may control the rotational speed of the motor 30 to reach the initial speed V0 stored in the memory and then perform the laundry distributing operation such that the initial speed V0 is maintained.

When the laundry distributing operation is completed, the washing machine 1 may return to step S15 to determine whether the degree of laundry distribution satisfies the allowable range.

Accordingly, the washing machine 1 may perform the laundry distributing operation in which the initial speed V0 is maintained after activating the motor again, securing Reliability for the laundry distributing operation to distribute the laundry evenly and the calibration speed Vn determined after the laundry distributing operation.

According to the present disclosure, it is possible to provide a rotational speed (RPM) that is advantageous for the laundry to be distributed evenly in the drum based on the vibration information detected by the vibration sensor, thus maximizing the laundry distribution ability.

According to the present disclosure, it is possible to quickly solve an unbalanced state in which laundry distribution is inappropriate, thus shortening a time required for the dewatering stroke.

According to the present disclosure, it is possible to reducing the vibration and noise caused by the laundry biased to one side in the drum.

What is claimed is:

1. A method of controlling a washing machine, the washing machine including a cabinet having an opening through which laundry is inserted or withdrawn, a tub installed in the cabinet, a drum rotatably provided in the tub, a motor configured to rotate the drum, a vibration sensor installed in the tub, and a controller, the method comprising:

performing a rinsing operation in which a tumble motion for rinsing laundry is performed after water is supplied to the drum;

after the rinsing operation is finished, performing a drainage process in which the water is drained from the tub;

determining an initial rotational speed for the motor based on vibration information detected by the vibration sensor in the drainage process that occurs after the rinsing operation is finished; and performing a laundry distributing operation that involves rotation of the drum based on the determined initial rotational speed for the motor, wherein the initial rotational speed for the motor is determined based on an intersection time point at which vibration of a fundamental wave and vibration of higher harmonics, detected by the vibration sensor, intersect with each other.

2. The method of claim 1, further comprising:

determining whether a degree of laundry distribution satisfies an allowable range by comparing information detected by the vibration sensor with previously stored reference information;

controlling a rotational speed of the motor to accelerate or decelerate between a lowest reference speed and a highest reference speed based on a determination that the degree of laundry distribution is outside of the allowable range; and determining a calibration speed based on the intersection time point at which the vibration of the fundamental wave and the vibration of the higher harmonics, detected by the vibration sensor, intersect with each other.

3. The method of claim 2, wherein controlling the rotational speed of the motor to accelerate or decelerate includes:

controlling the rotational speed of the motor to decelerate from a current rotational speed of the motor based on the vibration of the fundamental wave being larger than the vibration of the higher harmonics, and controlling the rotational speed of the motor to accelerate from the current rotational speed of the motor based on the vibration of the fundamental wave being smaller than the vibration of the higher harmonics.

4. The method of claim 2, wherein the lowest reference speed is set to 40 RPM, and the highest reference speed is set to 80 RPM.

5. The method of claim 2, further comprising:

performing a calibration laundry distributing operation in which the rotational speed of the motor is maintained at the determined calibration speed; and determining again whether the degree of laundry distribution satisfies the allowable range by comparing the information detected by the vibration sensor with the previously stored reference information after the calibration laundry distributing operation is performed.

6. The method of claim 5, further comprising:

returning to controlling the rotational speed of the motor to accelerate or decelerate based on a determination that, after the calibration laundry distributing operation is performed, the degree of laundry distribution remains outside of the allowable range.

7. The method of claim 2, wherein the lowest reference speed is defined as a rotational speed at which tumble of laundry starts, and wherein the highest reference speed is defined as a rotational speed at which attachment of laundry starts.

8. The method of claim 2, wherein controlling the rotational speed of the motor to accelerate or decelerate includes:

determining whether a current rotational speed of the motor is larger than or equal to the lowest reference speed or is smaller than or equal to the highest reference speed; and stopping and then actuating the motor based on a determination that the current rotational speed of the motor is smaller than the lowest reference speed or is larger than the highest reference speed.

9. The method of claim 1, wherein the initial rotational speed for the motor is determined based on a time point at which the vibration of the fundamental wave and the vibration of the higher harmonics first become identical to each other.

10. The method of claim 1, further comprising:

performing a main dewatering operation that involves rotating the drum at a high speed based on a determination that a degree of laundry distribution satisfies the allowable range.

11. The method of claim 2, further comprising causing the rotational speed of the motor to reach the highest reference speed while repeating acceleration or deceleration from the lowest reference speed.

12. The method of claim 11, further comprising obtaining fundamental wave information with a lowest frequency and higher harmonic information with a frequency that is an integer multiple of the frequency of the fundamental wave.

13. The method of claim 12, wherein the intersection time point is defined as a first time point at which the vibration of the fundamental wave and the vibration of higher harmonics have a same value, and wherein determining the initial rotational speed for the motor comprises detecting a rotational speed of the motor at the intersection time point and determining the detected rotational speed as the initial rotational speed for the motor.

14. The method of claim 1, further comprising controlling the motor such that a mean value of the rotational speed of the motor during the laundry distributing operation becomes the initial rotational speed for the motor.

* * * * *